United States Patent [19]

Amancharla et al.

[11] 3,934,648

[45] Jan. 27, 1976

[54] WELL TUBING SYSTEM WITH ORIENTING COUPLING MEANS

[75] Inventors: Amareswar Amancharla, Dallas; Carter R. Young, Lewisville, both of Tex.

[73] Assignee: Otis Engineering Corporation, Dallas, Tex.

[22] Filed: Dec. 18, 1974

[21] Appl. No.: 533,807

[52] U.S. Cl. ..... 166/116; 166/189; 285/25; 285/137 A

[51] Int. Cl.[2] ..... E21B 33/12; F16L 39/00

[58] Field of Search ..... 166/116, 89, 189, 313; 285/27, 28, 24, 25, 137 A

[56] References Cited

UNITED STATES PATENTS

| | | | |
|---|---|---|---|
| 3,693,714 | 9/1972 | Baugh | 285/25 |
| 3,807,497 | 4/1974 | Baugh | 285/137 A |

*Primary Examiner*—James A. Leppink
*Attorney, Agent, or Firm*—H. Mathews Garland

[57] ABSTRACT

A well tubing system for releasably coupling lower tubing strings with upper tubing strings in a well bore without rotation from the surface including a well packer on a plurality of lower tubing strings, a first flow coupling and guide sleeve on the upper end of the packer, and a second flow coupling and guide head on the lower ends of the upper tubing strings. The upper tubing strings and guide head are connected with and disconnected from the guide sleeve on the packer by longitudinal motion only. The guide head has spiral guide surfaces leading to a vertical orienting slot. The guide sleeve includes a guide lug which engages the guide head guide surfaces and slot to rotate the head and upper tubing strings to the desired orientation. In alternate forms of the invention means are provided for the running and retrieving of either one or both of the upper tubing strings independently of the other of the strings after the initial connection of the guide head into the guide sleeve in the well bore.

16 Claims, 16 Drawing Figures

WELL TUBING SYSTEM WITH ORIENTING COUPLING MEANS

This invention relates to well tools and more particularly relates to a well tubing system including a plurality of flow conductors which are installed and retrieved without rotation from the surface.

It is a principal object of the invention to provide new and improved forms of well tools.

It is another object of the invention to provide new and improved forms of well tubing systems.

It is a particularly important object of the invention to provide a new and improved form of well tubing system in which at least two parallel tubing strings may be installed and retrieved as a unit without rotation at the surface to properly align and couple the tubing strings with a packer in the well bore.

It is another object of the invention to provide a selfaligning form of tubing string assembly which is lowered, oriented and latched with a well packer in a well bore without surface orientation and rotation.

It is another object of the invention to provide a well tubing string assembly including at least two parallel tubing strings which are lowered and latched with a well packer by use of a guide head having a circumferential guide slot which coacts with a guide lug within a guide sleeve supported on the well packer.

It is another object of the invention to provide a well flow conductor system in which at least two well flow conductors may be installed in a well bore and coupled with a well packer simultaneously without rotation of the flow conductor assembly at the surface and thereafter at least one of the flow conductors may be retrieved and reinstalled independently of the other flow conductor.

It is still another object of the invention to provide a well flow conductor system of the character described wherein each flow conductor in the system may be independently installed and retrieved and the flow conductor package may also be installed and retrieved as a unit without rotation at the surface.

In accordance with the foregoing objects and advantages there is provided a well flow conductor system wherein at least two well flow conductors may be run into a well bore and latched with a well packer without rotation of the flow conductor unit from the surface. The system includes self-orienting features comprising a body having parallel spaced bores and connectible at a lower end with a well packer in a well bore supporting on the other end thereof a tubular guide sleeve having an inwardly extending guide lug. Parallel well flow conductors are connected with a guide head having an external circumferentially extending guide slot which encompasses the entire circumference of the guide head for coaction with the guide lug in the guide sleeve at any position of rotation at which the guide head is lowered by the tubing strings into the guide sleeve. The guide head is provided with spaced parallel bores each communicating with one of the tubing strings connected into the head. The lower free end of the guide head is provided with one tubular lock-and-release collet latch connected with the first of the bores through the head for releasably latching the guide head with the body after orientation by the coaction of the guide lug and a guide slot in the head. A tubular seal unit is connected with the lower free end of the guide head communicating with the second bore of the guide head for insertion into the second bore of the body. In one alternate form of the invention a releasable coupling and scoop head are provided to permit running and retrieving one of the flow conductors independently of the other conductor. In another form of the invention a releasable coupling and scoop head is provided for each of the flow conductors so that each flow conductor may be installed and retrieved independently of the other conductor.

The objects and advantages of the invention will be better understood from the following detailed description of preferred embodiments thereof taken in conjunction with the accompanying drawings wherein:

FIGS. 1A, 1B and 1C taken together constitute a longitudinal view in section and elevation of a preferred form of the invention wherein two tubing strings are installed and retrieved as a unit;

Figure 6:
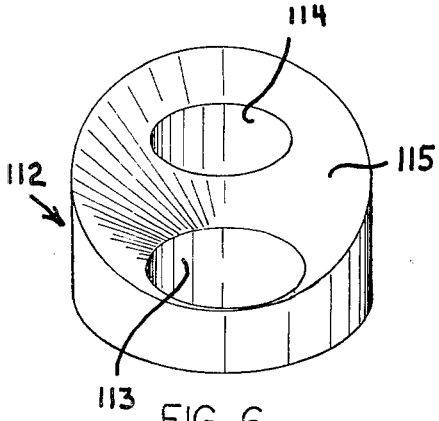
Figure 5A:
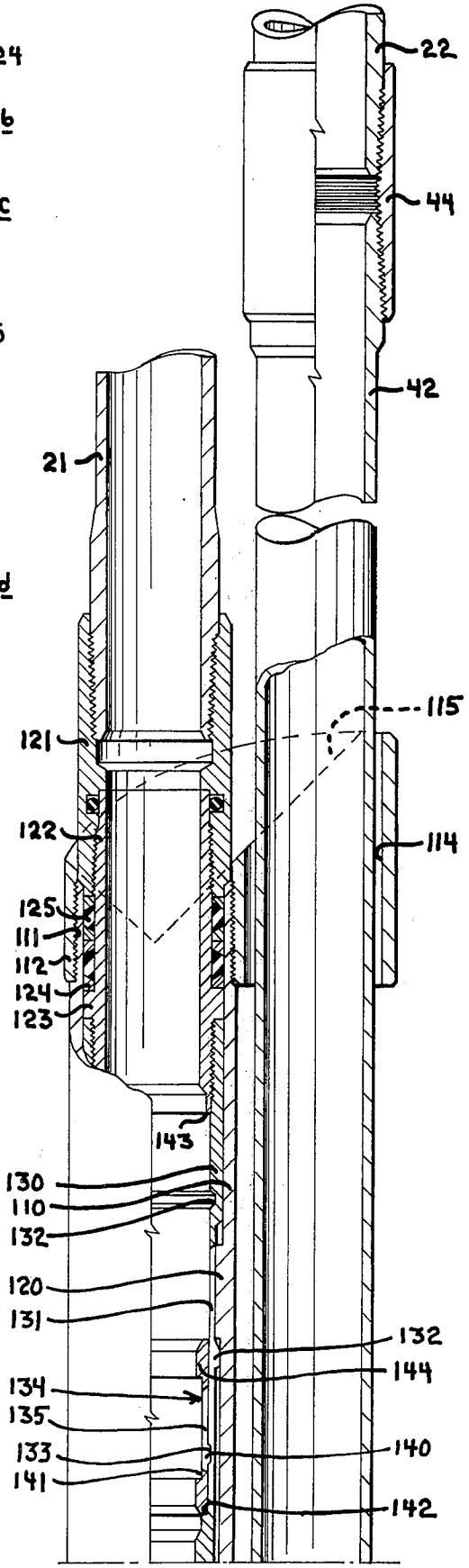
Figure 8B:
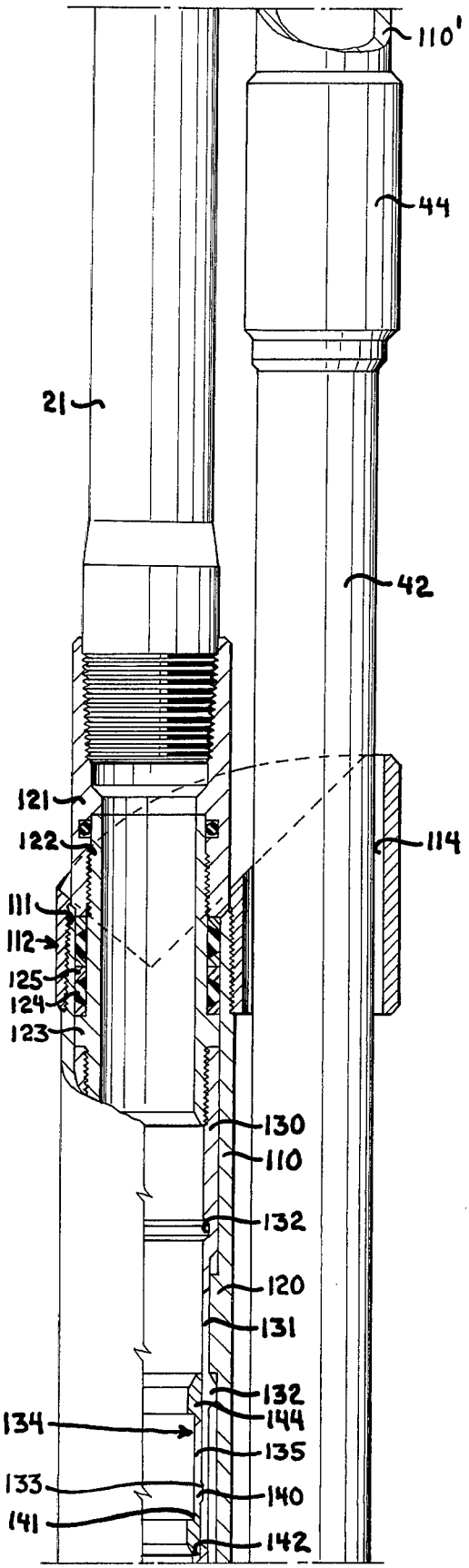
Figure 8C:
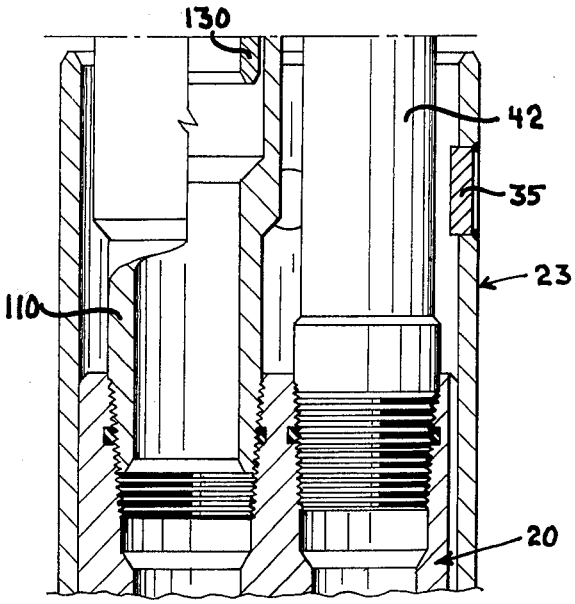
Figure 7:
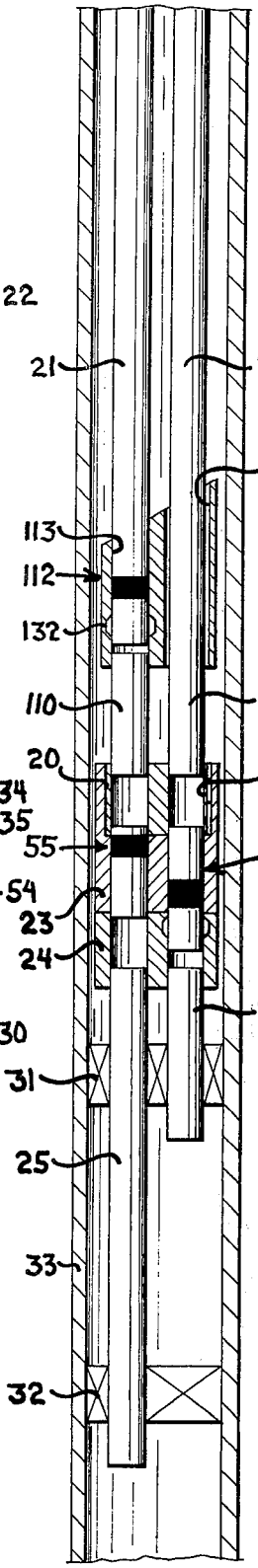
Figure 5B:
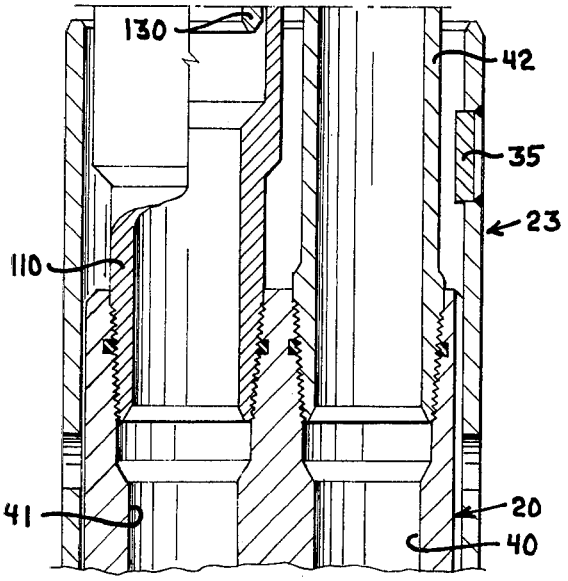
Figure 9:
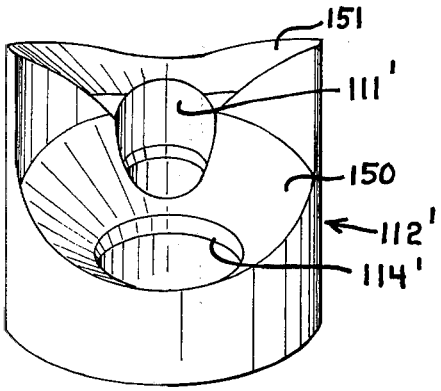
Figure 10:
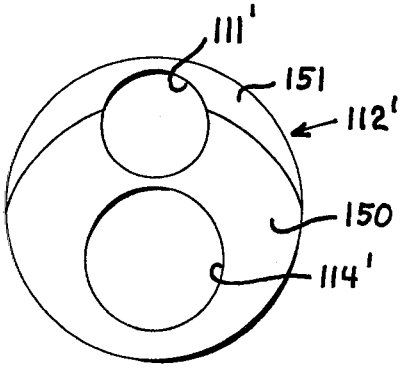
Figure 8A:
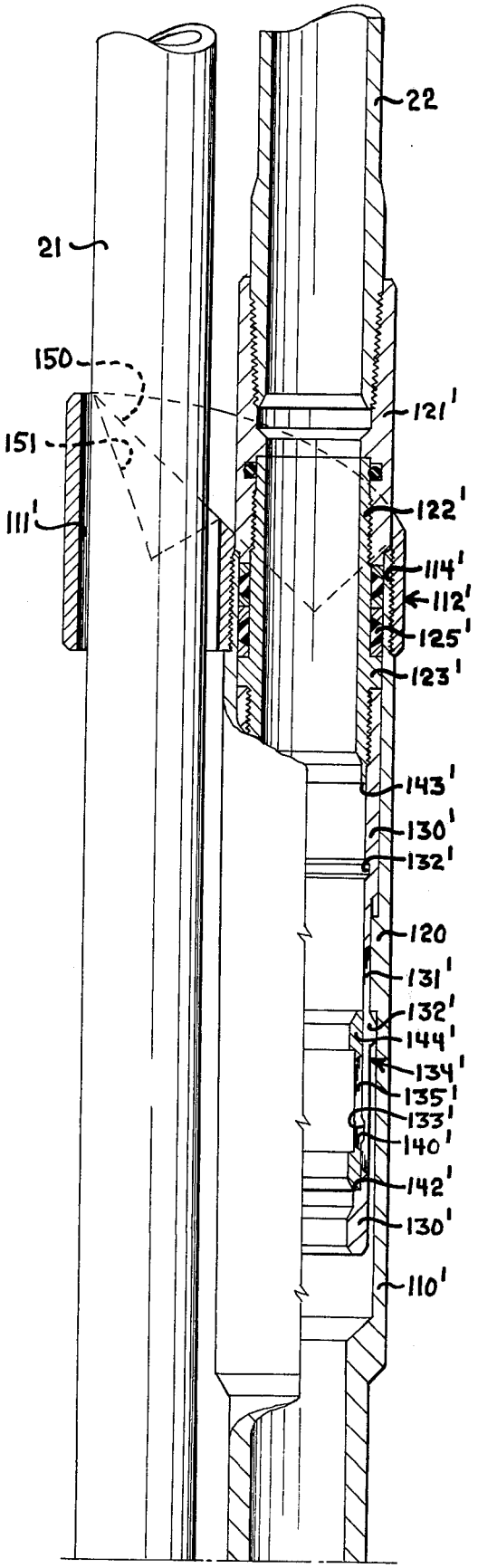

FIGS. 5A and 5B taken together constitute a longitudinal view in section and elevation of one alternate form of the invention including one independently retrievable flow conductor;

FIG. 6 is a perspective view of a scoop head employed in the embodiment of the invention illustrated in FIGS. 5A and 5B;

FIG. 7 is a schematic longitudinal view in section and elevation illustrating the flow conductor system shown in FIGS. 5A, 5B and 6 coupled with well packers installed in a well bore;

FIGS. 8A, 8B, and 8C taken together constitute a longitudinal view in section and elevation of another embodiment of the invention wherein each of the tubing strings is independently retrievable and installable;

FIG. 9 is a perspective top view of the upper scoop head employed in the form of the invention illustrated in FIGS. 8A, 8B, and 8C;

FIG. 10 is a top plan view of the head shown in FIG. 9; and

Figure 11:
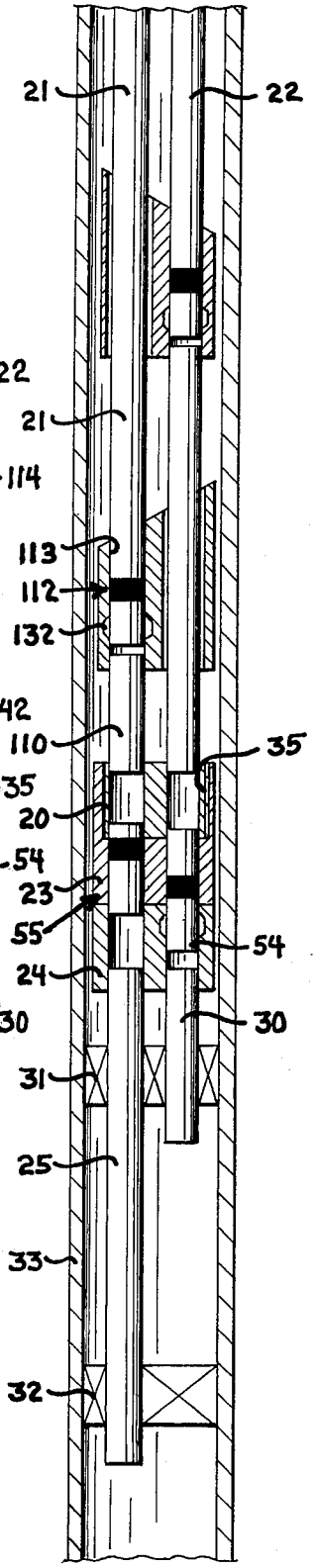

FIG. 11 is a longitudinal schematic view in section and elevation of the alternate form of the invention shown in FIGS. 8A, 8B, 8C and 10.

Figure 3:
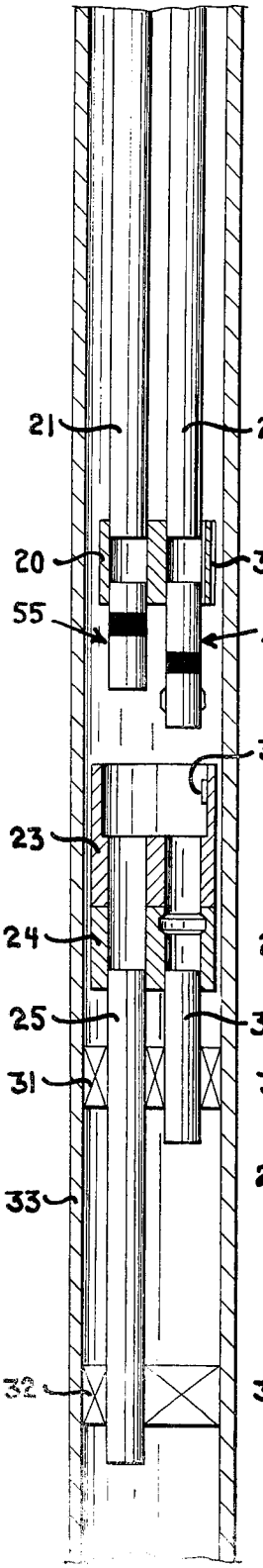
FIG. 3 is a schematic view in section and elevation illustrating the lowering of two tubing strings in accordance with the invention into a guide sleeve coupled with well packers in a well bore.

Referring to FIG. 3, the simplest form of the invention wherein two tubing strings are installed and retrieved as a unit comprises a guide head 20 coupled with a pair of parallel tubing strings 21 and 22 and a guide sleeve 23 connected with a body 24 secured with a pair of lower tubing sections 25 and 30. The lower tubing sections 25 and 30 connect with an upper dual packer 31 and a lower single packer 32 which are set in a well casing 33 so that well production from an upper formation may flow through the tubing section 30 while a lower formation is produced through the tubing section 25. The packers 31 and 32 are conventional in design and may be installed and retrieved by suitable standard techniques. Their basic function is to seal the well bore annulus within the casing around the particular tubing strings coupled with the packers. They serve to isolate spaced producing formations along the well bore and permit desired production and well techniques to be carried out in the well bore.

In accordance with the invention the pair of tubing strings 21 and 22 may be installed and retrieved as a unit by coupling and uncoupling with the guide sleeve 23 and body 24 without rotation of the tubing string unit at the surface of the well. The primary object of the invention which is the self-orientation of the tubing string unit for installation and retrieval without rotation is accomplished by use of the guide head 20 which includes a self-orienting guide slot 34 which coacts with an internal guide lug 35 in the guide sleeve 23 for properly orienting the guide head preliminary to effecting a sealed coupled relationship of the tubing strings into the body 24. The guide slot 34 is an external circumferential slot milled into the outer surface of the head 20 extending 360° around the head so that the head may enter the guide sleeve at any position of rotation and be turned by the lug 35 to the proper position for a sealed coupling to be accomplished.

Figure 1A:
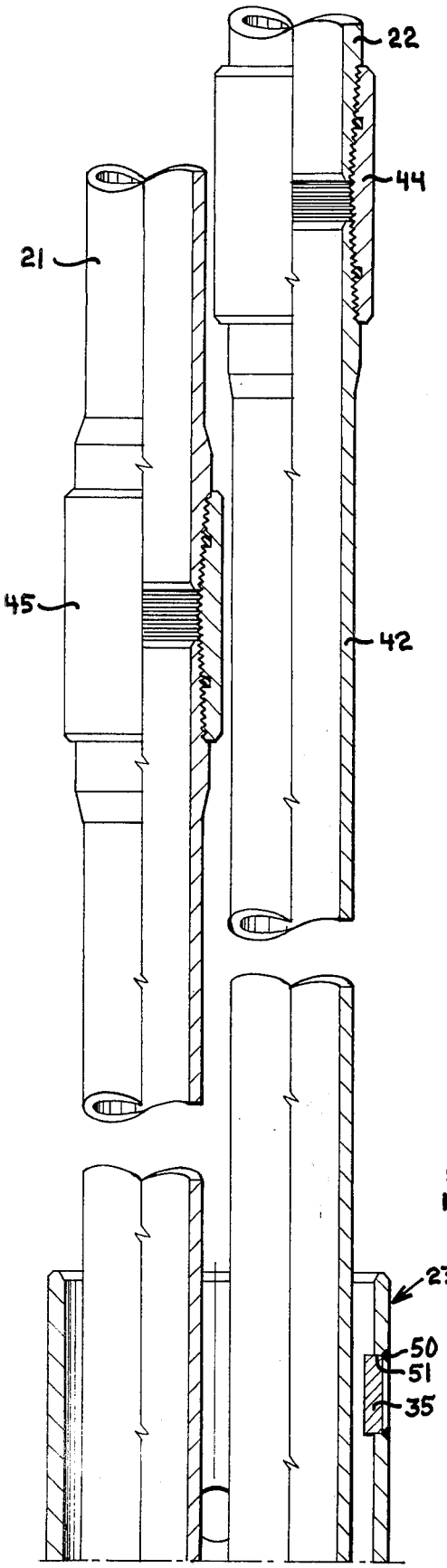
Figure 1B:
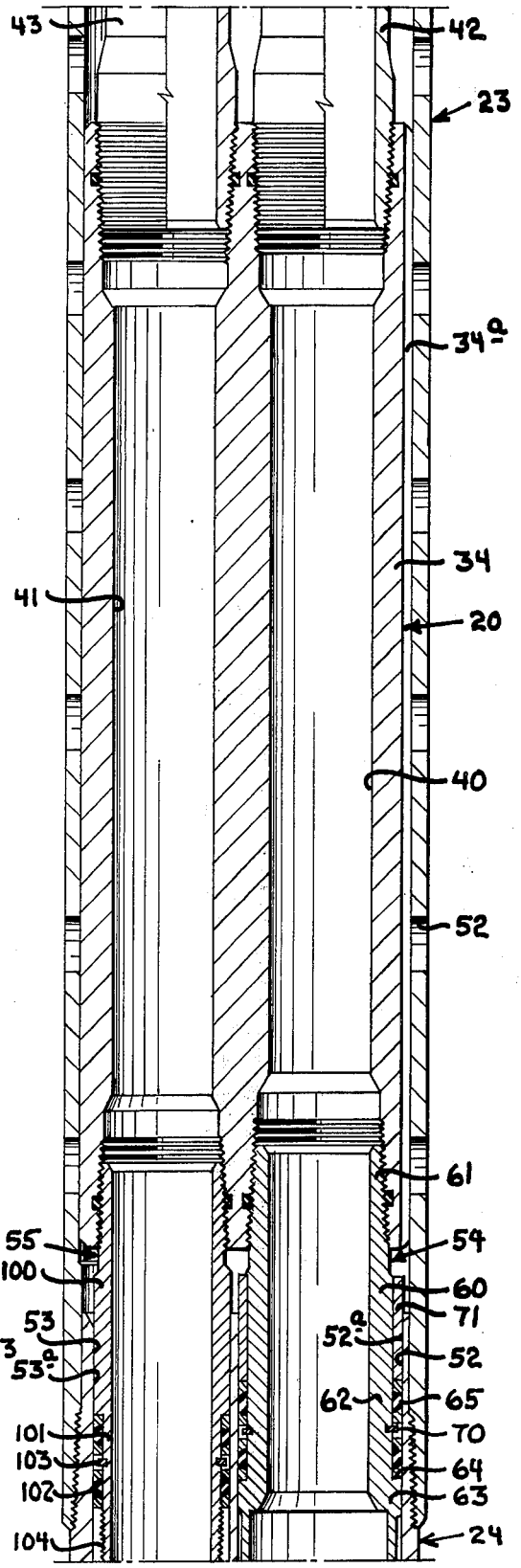
Figure 1C:
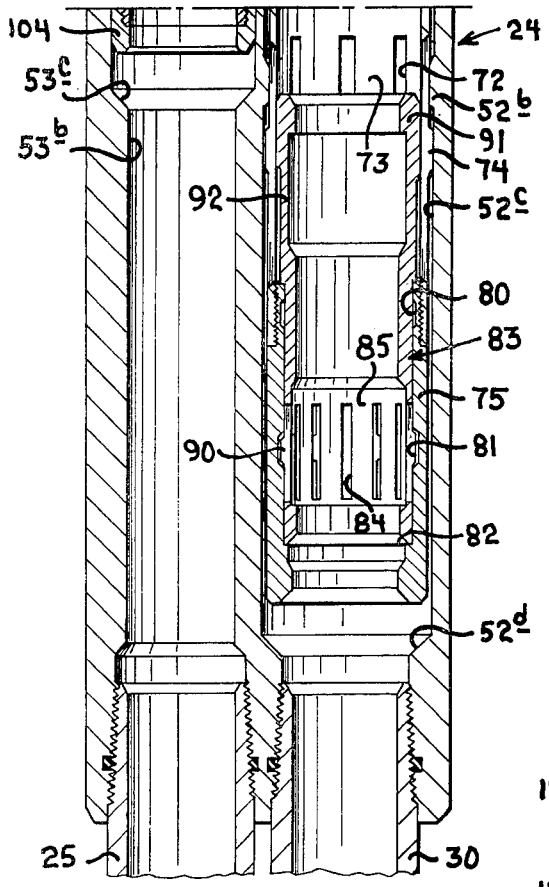
Figure 2:
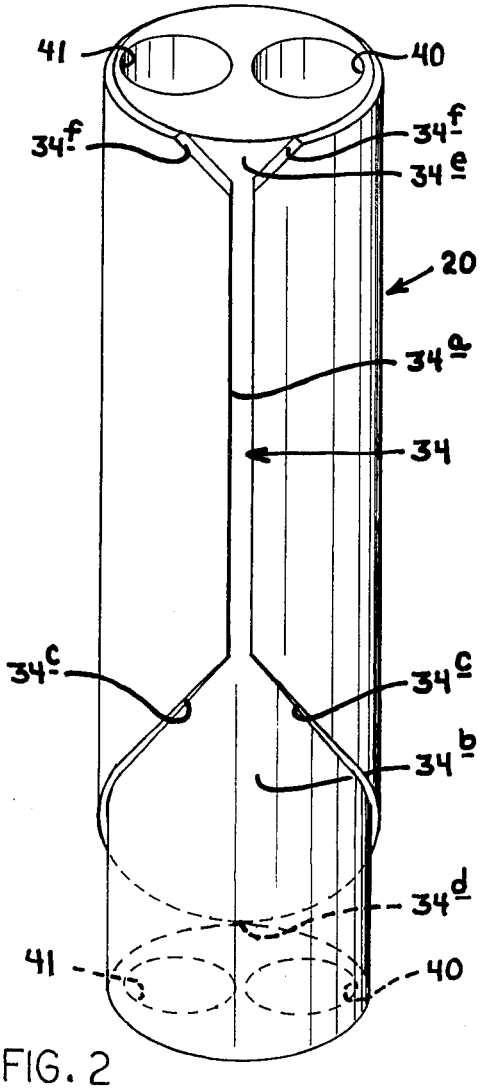
FIG. 2 is a perspective of the self-aligning guide head used in each embodiment of the invention.

The specific details of the flow conductor assembly shown in FIG. 3 are illustrated in FIGS. 1A, 1B, 1C and 2. Referring particularly to FIG. 2 the guide head 34 is a cylindrical member having a pair of spaced parallel longitudinal bores 40 and 41 which extend the full length of the member opening through opposite ends for communication of fluids with the tubing strings 21 and 22 and the lower tubing sections 25 and 30. The bores 40 and 41 are internally threaded at opposite ends as more clearly seen in FIG. 1B. The guide slot 34 has a vertical portion 34a which is slightly wider than the guide lug 35 within the guide sleeve 23 so that the guide head will readily slide downwardly along the lug. The guide slot 34 has a lower entrance or mouth portion **34*b* defined by a pair of divergent slot edge surfaces 34*c* which spiral apart downwardly and outwardly in opposite directions around the guide head substantially meeting at the lower end of the head on the opposite side from the slot portion 34*a* defining a pointed lower end 34*d* at the lower end of the head. The upper end of the slot 34 is flared outwardly at 34*e* defining an exit or discharge end portion formed by outwardly flared slot edges 34*f*. The slot edges 34*c* and 34*f* are each formed at substantially 45° angles with the vertical edges of the slot portion 34*a*. The slot edges 34*c* and 34*f* each function as cam surfaces which coact with the guide lug 35 rotating the guide head 20 to align the head at a position of rotation which causes entry of the guide lug into the slot portion 34*a* depending upon the direction of movement of the guide head relative to the lug. As the guide head is lowered into the guide sleeve 23 the guide lug strikes one or the other of the slot edge surfaces 34*c* defining the slot mouth 34*b* unless, of course, the guide head is exactly aligned to cause the pointed slot edge surface portion 34*d* to strike the guide lug in which case the guide head is deflected to rotate in one direction or the other depending upon the exact angle portion of the point which strikes the guide lug. Under either circumstance, whether the point 34*d* lands on the guide lug or one of the slot edge portions 34*c* clearly engages the guide lug the cam action between the slot edge surface 34*c* and the guide lug causes the guide head to be rotated as the head is lowered until the lug enters the vertical slot portion 34*a*. At the position of rotation at which the lug enters the vertical slot portion the guide head is properly aligned for coupling into and sealing with the body 24. Similarly as the guide head is lifted upwardly from the body one of the slot edge surfaces 34f insures that the lug enters the vertical slot portion 34a** to properly guide the head as it is retrieved from the body and guide sleeve.

A pair of parallel spaced pup joints 42 and 43 are threaded at lower ends into the upper threaded end portion of the guide head bores 40 and 41, respectively. The upper ends of the pup joints 42, and 43 are connected with couplings 44 and 45 which are secured with the lower ends of the tubing strings 22 and 21, respectively.

The guide sleeve 23 is a cylindrical member threaded at a lower end onto the upper end of the body 24. The guide lug 35 within the guide sleeve is a cylindrical member projecting into the sleeve and suitably welded at 50 through a hole 51 in the sleeve. The guide sleeve has a plurality of holes 52 spaced along the length of the sleeve and around the sleeve for free flow of fluid into and out of the sleeve during the insertion and removal of the guide head 20 when installing and retrieving the flow conductors.

The body 24 has a pair of longitudinal spaced bores 52 and 53 aligned with the bores 40 and 41, respectively, of the guide head 20 when the head is in operating position within the guide sleeve 23. The bore 52 has an upper seal section **52*a*, an internal annular locking boss 52*b*, and a lower bore portion 52*c* below the locking boss. The bore portion 53 has an upper seal section 53*a* and a reduced lower section 53*b*. An internal stop shoulder 52*d* is defined within the body 24 at the lower end of the bore 52*c*. An internal annular stop shoulder 53*c* is formed within the bore 53 between the upper seal section 53*a* and the lower reduced bore section 53*b*. The body 24 is internally threaded along the lower end portions of each of the bores 52 and 53 for connection of the body with the pipe sections 25 and 30 which couple the body with the upper and lower packers 31 and 32 as seen in FIG. 3. The lower end of the guide head 20 is internally threaded around the lower end portions of both of the bores 40 and 41 for connection of the guide head with a lock-and-release collet latch 54 and a tubular seal unit 55. The collet latch 54 is threaded into the lower end of the bore 40 of the guide head while the seal unit 55 is threaded into the lower end of the bore 41 of the head. The collet latch communicates the bore 40 with the body bore 52 while releasably locking the guide head and related structure with the body. The seal unit 55 telecscopes in sealed relationship into the bore 53 for communication of the guide head bore 41 with the bore 53** of the body.

The lock-and-release collet latch 54 includes a tubular latching sub 60 having a reduced threaded upper end portion 61 and a central seal section 62 having an external flange portion 63 defining an upwardly facing stop shoulder 64 which supports an annular seal assembly 65 retained by a lock ring 70 on the sub portion 62. An annular spacer 71 is disposed on the sub section 62 above the seal assembly. The sub 60 has a plurality of circumferentially spaced longitudinal slots 72 extending along the central portion of the latching sub defining circumferentially spaced locking collet fingers 73 each of which has an external locking boss 74 adapted to latch below the internal locking boss 52b around the bore 52 of the body 24 for releasably locking the collet latch in the bore. The lower end of the latching sub is threaded onto a bottom sub 75 which has a pair of longitudinally spaced internal annular locking recesses 80 and 81. The lower end of the bottom sub 75 is reduced defining an upwardly facing internal annular stop shoulder 82. An internal locking collet sleeve 83 is positioned for longitudinal movement within the bore of the bottom sub 75 extending upwardly into the latching sub 60 for releasably locking the latching sub in the bore 52 of the body 24. The sleeve 83 has a plurality of circumferentially spaced longitudinal slots 84 which define circumferentially spaced longitudinal collet sections 85 each of which has an external locking boss 90 which is receivable in the locking recesses 80 and 81 of the bottom sub 75 depending upon whether the collet sleeve is at an upper release position or a lower locking position. The collet sleeve 83 has an enlarged upper end portion 91 and is reduced in diameter below the head portion 91 along a release section 92. When the collet sleeve 83 is latched at the lower locking position shown in FIG. 1C the sleeve head 91 is aligned within the latching sub collet finger portions 74 propping the portions 74 outwardly in the bore 52 below the locking boss 52*b* so that the collet latch 54 is locked at the position of FIG. 1C in the bore 52 of the body 24, thereby holding the guide head 20 against upward movement from the body 24. When the collet sleeve 83 is lifted in the bore of the latching sub to an upper position at which the bosses 90 on the collet finger portion 85 are aligned with the locking recess 80 within the bottom sub 75 the head 91 is above the latching sub bosses 74 so that the latching sub fingers 73 may spring inwardly to release the collet latch 54 from the bore of the body 24 when the tubing strings and guide head 20 are to be retrieved by lifting them upwardly from the body 24 and the guide sleeve 23. The collet sleeve 83 has an internal bore profile which is compatible with Type B Otis Positioning Tool illustrated and described at page 3968 of the *Composite Catalog of Oilfield Equipment and Services*, 1974–75 Edition, published by World Oil, Houston, Texas. The positioning tool is operated by suitable wireline equipment for locking and releasing the collet latch 54 when running and retrieving the tubing string assembly of the invention.

The seal unit 55 is not a locking unit of the nature of the collet latch 54 but rather is simply a tubular seal assembly which telescopes into the bore portion 53*a* to form a sealed connection between the bore 53 of the body 24 and the bore 41 through the guide head 20. The seal unit 55 includes a tubular mandrel 100 threaded along an upper end portion into the lower threaded end section of the bore 41 of the guide head 20. The mandrel 100 is reduced in diameter along a lower end portion providing a section 101 along which an annular seal assembly 102 is supported by a lock ring 103. An annular retainer 104 is threaded on the lower end portion of the mandrel 100.

As evident in FIGS. 3 and 1C the collet latch 54 extends downwardly substantially below the lower end of the seal unit 55, both the collet latch and seal unit projecting from the lower end of the guide head 20. The relative longitudinal positioning of the collet latch 54, the vertical straight guide slot portion 34a in the guide head 20, the bore 52 of the body 24, and the guide lug 35 locates the lug well down in the vertical portion of the guide slot on the guide head as the collet latch enters the bore 52 of the body 24 to insure proper orientation of the guide head with the collet latch and the seal unit while the guide lug is still well within the guide slot as the guide head is lowered in the guide sleeve during the running of the tubing string assembly.

The flow conductor system of the invention is especially adapted for certain offshore installations where the preferred procedure is the installation of the necessary packers preliminary to running the tubing strings which may be inserted as a unit supported from the christmas tree and lowered to and coupled with the previously installed packer assembly. This particular technique is represented in FIG. 3 wherein the two packers together with the head 24 and the guide sleeve 23 are installed in the well casing before running the tubing strings as a unit. Dual and single packers 31 and 32, respectively, may be suitable conventional packers such as those which are hydraulically set in the well bore. The packers may be run together or may be individually set in the well casing 33 such as by first installing the lower single packer 32 and thereafter setting the upper dual packer 31. Whichever packer installation procedure is selected at the time the dual packer 31 is set it is made up with the head 24 and guide sleeve 23. The flow couplings 25 and 30 are connected at the surface between the packer 31 and the body 24. The guide sleeve 23 is connected with the body 24 so that the packer, flow couplings, body, and guide sleeve are interconnected as a unit in the relationship represented in FIGS. 1A, 1B, and 1C. This unit assembly is then installed in the casing 33 at the proper depth and the packer 31 set to seal the casing annulus between the inner wall of the casing and the flow couplings 25 and 30. Following the installation of the upper packer with the body and guide sleeve the tubing string unit including the strings 21 and 22 are assembled at the surface with the guide head 20. The tubing strings are connected into the upper end of the guide head as shown in FIG. 1A while the collet latch 54 and seal unit 55 are secured into the lower end of the guide head 20 as illustrated in FIGS. 1B and 1C. The unit comprising the guide head with the collet latch and seal unit is then lowered in the well casing as sections of the tubing string are sequentially added at the surface until the guide head is reaching the proper depth in the well bore. FIG. 3 represents schematically the lowering of the guide head and tubing string unit toward the previously installed packer assembly with the guide sleeve 23. The last and uppermost sections of the tubing strings are connected into the wellhead christmas tree and the apparatus related to the tree so that the tubing strings may be lowered with and secured in the well bore simultaneously with the connection of the christmas tree at the wellhead. It will be understood that the tubing strings are supported from the wellhead and in view of the particular features of the invention may be installed without rotation at the surface of the strings and wellhead. The tubing string guide head unit is thus lowered with the collet latch 54 and seal unit 55 first entering the upper end of the guide sleeve 23. As the guide head 20 enters the guide sleeve one of the cam surfaces 34*c* defined by the edges of the slot 34 at the lower end of the guide head engages the guide lug 35 with coaction between the cam surface and the guide lug causing the guide head to rotate toward the vertical slot portion 34*a* as the the guide head is lowered by the tubing strings. Before the lower end of the collet latch 54 reaches the bore 52 at the upper end of the body 24 the guide head is at a longitudinal position at which the guide lug has entered the vertical narrow guide slot portion 34a. In order to properly orient the guide head 20 for correct alignment of the collet latch 54 and the seal unit 55 the guide lug and guide slot will have rotated the guide head clockwise or counterclockwise depending upon the position of rotation of the guide head upon initial entry into the guide sleeve. Under any circumstances the guide head will not be required to rotate more than 180° which is well within the twisting tolerance permitted the tubing strings between the christmas tree and the guide head which will generally be a distance of several thousand feet. The tubing string and guide head unit are properly aligned when the guide lug is in the guide slot portion 34a for entry of the collet latch 54 and the seal unit 55 into the body bores 52 and 53, respectively. The guide head is lowered by the tubing strings with the collet latch and seal unit moving downwardly fully into the locking sealed positions illustrated in FIGS. 1B and 1C. Preliminary to the lowering of the guide head and tubing string unit in the well casing the collet sleeve 83 in the collet latch 54 is at an upper release position at which the locking bosses 90 on the collet sleeve fingers 85 are aligned with and engagement in the upper locking recess 80 of the bottom sub 75. At this upper release position of the collet sleeve 83 the enlarged head portion 91 of the collet sleeve is above the latching sub locking bosses 74 with the reduced collet sleeve portion 92 being aligned with the bosses 74 so that the bosses spring inwardly past the locking flange **52*b* around the bore 52 of the body 24 as the guide head is lowered into the guide sleeve. The locking bosses 74 snap downwardly below the locking flange 52*b* expanding outwardly below the locking flange to releasably lock the collet latch and thus the guide head and associated apparatus and tubing strings with the body 24. Of course at the same time the tubular seal unit 55 enters in sealed relationship in the bore 53 of the body 24. After the guide head and tubing string unit is coupled with the guide sleeve body as described a suitable positioning tool, previously discussed, is run into the tubing string 22 from the surface to engage the collet sleeve 83 which is moved downwardly to the position shown in FIG. 1C. The locking bosses 90 on the collet sleeve fingers 85 spring inwardly out of the locking recess 80 and when the sleeve moves downwardly to a lower end position as shown the bosses 90 expand into the lower locking recess 81, thereby locking the sleeve 83 at the lower end position. The enlarged head portion 91 is aligned within and behind the latching sub locking bosses 74 holding the bosses outwardly below the internal locking flange 52b of the body 24 so that the guide head 20 cannot be pulled upwardly from the body 24, thereby locking the guide head and the tubing strings in a sealed relationship on the body 24** above the upper packer. With the tubing strings so installed in the well bore connected with the packers various desired well procedures including production of well fluids may be carried out. It will be recognized that the parallel tubing strings along with the guide head were lowered and fully installed in the well bore without rotation at the surface due to the selfaligning feature provided by the cooperative relationship of the guide lug in the guide sleeve and the guide slot on the guide head.

When desired the tubing strings along with the guide head are retrievable as a unit. There are a number of reasons why such removal of the tubing strings may be desired. For example, any valves which may be installed in the tubing strings may be retrieved and inspected and reinstalled. Similarly, damage to the tubing strings may be inspected and repaired. A number of other reasons may exist for withdrawal of the tubing strings from the well bore without removing the packers 31 and 32. In order to release the guide head and associated structure from the packers for retrieval of the tubing strings and guide head as a unit a wireline positioning tool is run into the tubing string 32 engaging the locking collet sleeve 83 which is moved upwardly to a release position at which the head 91 is above the latching sub locking bosses 74 so that the bosses may cam inwardly to permit the collet latch to be pulled upwardly past the locking flange **52*b*. As the tubing strings and guide head are lifted upwardly the guide lug 35 re-enters the guide slot 34 before the collet latch 54 and the seal unit 55** are withdrawn from the body bore.

The particular form of the invention illustrated in FIGS. 1A, 1B, 1C, 3, and 4 require that the tubing strings 21 and 22 along with the guide head 20 be installed and retrieved as a unit. The tubing strings are not retrievable independently of each other. FIGS. 5A, 5B, and 6 illustrate an alternate form of the invention which permits independent running and retrieval of the secondary tubing string 21 independently of the primary string 22. In this alternate form of the invention the guide head 20, the collet latch 54, the seal unit 55, the guide sleeve 23 and body 24 along with the connection of the primary string 22 into the guide head are all identical to the previously described structure illustrated in FIGS. 1B and 1C. Referring to FIGS. 5A and 5B a tubular latch housing 110 is threaded along a lower end portion into the upper end of the guide head 20 connecting into the bore 41 of the guide head. The upper end of the latch housing 110 is threaded into a bore 111 of a scoop head 112. The scoop head has a top guide surface which has a substantially conical shape developed about an axis coincident with the axis of the bore 113 for guiding the lower end of a tubing string into the bore. The bore 114 is provided merely for the passage of the pup joint 42 and the guide surface 115 is developed about the bore 113 and thus will not guide a tubing string into the bore 114. The latch housing 110 has an internal annular locking flange 120 for releasably locking the tubing string 21 with the latch housing. A coupling 121 is connected on the lower end of the tubing string 21. A seal mandrel 122 is threaded into the lower end of the coupling 121. The seal mandrel has an external stop shoulder 123 spaced along the mandrel to define a seal recess 124 between the stop shoulder and the lower end edge of the coupling 121. An annular seal assembly 125 is disposed in the recess 124 to seal the connection of the tubing string into the latch housing 110. A locking collet sleeve 130 is threaded on the lower end portion of the seal mandrel 122 and sized to enter the bore of the latch housing 110. The latch sleeve 130 has a plurality of circumferentially spaced radially flexible collet fingers 131 each of which has an external locking boss 132 expandable in the bore of the latch housing below the locking flange 120. The collet sleeve 130 has longitudinally spaced upper and lower internal latch recesses **132*a* and 133, respectively, for holding an internal collet lock sleeve 134 in upper release and lower lock positions. The lock sleeve 134 has longitudinal circumferentially spaced collet fingers 135 each provided with an external locking boss 140 which is expandable into the locking recesses 132 and 133 of the collet sleeve 130. The collet locking sleeve has an internal annular operating recess 141 for engagement of a vertical positioning tool with the locking sleeve. An internal annular upwardly facing stop shoulder 142 within the sleeve 130 limits the downward movement of the locking collet 135 while the lower end edge 143 of the seal mandrel 122 limits the upward movement of the collet locking sleeve 135. In FIG. 5A the sleeve 134 is at a lower end locking position at which the head end of the sleeve 144 is disposed within the collet fingers 131 behind the locking bosses 132 on the fingers preventing inward compression of the fingers so that the locking bosses 132 latch the collet sleeve 130 against upward movement since the bosses 132 cannot move upwardly past the locking flange 120 within the latch housing 110. The sleeve 134 is movable upwardly to an upper end position at which the bosses 140 engage the locking recess 132***a*. At such upper position of the locking sleeve the fingers 131 are free to move inwardly so that the locking bosses 132 may pass upwardly within the locking flange 120 for releasing the tubing string 21 from the latch housing 110 so that the tubing string may be pulled upwardly from the latch housing thereby disconnecting the tubing string from the remaining apparatus coupled with the guide head 20. At the upper end position of the sleeve 134 the tubing string of course may not only be retrieved from the latch housing but also may be inserted into the latch housing. A suitable positioning tool handled on a wireline through the tubing string 23 is used to raise and to lower the locking sleeve 134 between the upper release and the lower latching positions during the retrieval and running of the tubing string 23 independently of the other well tubing structure.

The alternate form of the invention represented by FIGS. 5A and 6 including the other structure comprising the previously described guide head 20 with related apparatus may be installed and retrieved as a unit following the previously described procedure. After installation, however, of the tubing string unit the secondary string 21 may be independently retrieved and rerun in the well leaving the primary string and remaining structure in place in the well. A positioning tool is used to raise the locking sleeve 134 to the upper release position permitting the tubing string to be pulled upwardly from the latch housing 110. The structure which is pulled from the latch housing includes the coupling 121, the seal mandrel 122, the seal assembly 125, the locking collet sleeve 130, and the internal locking sleeve 134. When the secondary string 21 is retrieved and rerun the primary string 22 remains in place. Thus as the secondary string 21 is lowered back into the well casing the lower end of the collet sleeve 130 engages the guide surface 115 on the scoop head 112 guiding the tubing string latch assembly downwardly into the bore 113. The tubing string and latch assembly are lowered back to the position of FIG. 5A latching the tubing string with the latch housing 110. A positioning tool is then used to move the lock sleeve 134 downwardly to relock the bosses 132 outwardly below the lock flange 120 holding the secondary tubing string in the latch housing. FIG. 7 schematically represents the complete installation in a well utilizing the modified removable secondary tubing string feature illustrated in FIGS. 5A, 5B, and 6.

A still further modification of the invention illustrated in FIGS. 8A, 8B, 8C, 9, 10, and 11 provides a structure for the independent retrieval and running of each of the tubing strings after the self-aligning head and related structure are initially installed in a well bore. The alternate form of the structure which permits retrieval of both tubing strings is identical to that illustrated in FIGS. 5A, 5B, and 7 with the addition of features required for removal of the primary tubing string 22. All of the features of the independent tubing latching arrangement are identical to those described and illustrated in connection with FIGS. 5A and 5B with the exception of minor changes in the latch housing and the scoop head and thus such features as shown in FIGS. 8A and 8 will be identified by the same reference numerals used in FIGS. 5A and 5B with the addition of a prime (′) mark. Thus the dual retrievable tubing string form of the invention has all of the features of the single retrievable tubing form illustrated in FIG. 7 with such tubing latching features being duplicated on the primary string 22 as particularly shown in FIG. 8A. Above the scoop head 112 for the secondary tubing string a latch housing 110′ is connected with the coupling 44 which is supported on the pup joint 42. A dual scoop head 112′, shown in more detail in FIGS. 9 and 10, is supported on the latch housing 110′. The latch housing 110′ is identical to the housing 110 except for possible length differences required for the proper placement of the latching system for the primary string above that for the secondary string. The scoop head 112′ differs, however, from the scoop head 112 in the provision of dual guide surfaces since both tubing strings are run and retrieved through the upper scoop head 112′. Referring particularly to FIGS. 9 and 10 the scoop head 112′ has a first guide surface 150 lying in a conical plane which is concentric with the central longitudinal axis of the large bore 114′ for the primary string so that all portions of the guide surface slope inwardly toward the upper end of the passage of the bore 114′. The second guide surface 151 of the scoop head lies in a conical plane having an axis concentric with the axis of the smaller secondary bore 111′ so that all portions of the second guide surface slope inwardly toward the bore 111′. Further, more specific details of the features of the scoop head 112′ may be found in U.S. Pat. No. 3,288,218 issued Nov. 29, 1966, to Carter R. Young and assigned to Otis Engineering Corportion. The scoop head 112′ has two guide surfaces inasmuch as both tubing strings are installed and retrieved through the upper scoop head. All of the other features of the latching system for the primary string 22 including the coupling 121′, the seal mandrel 122′, the seal assembly 125′, the collet latch sleeve 130′, and the collet lock sleeve 134′ are identical to the components previously described in detail in connection with the tubing latching system for the secondary string shown in FIGS. 5A and 5B.

Figure 4:
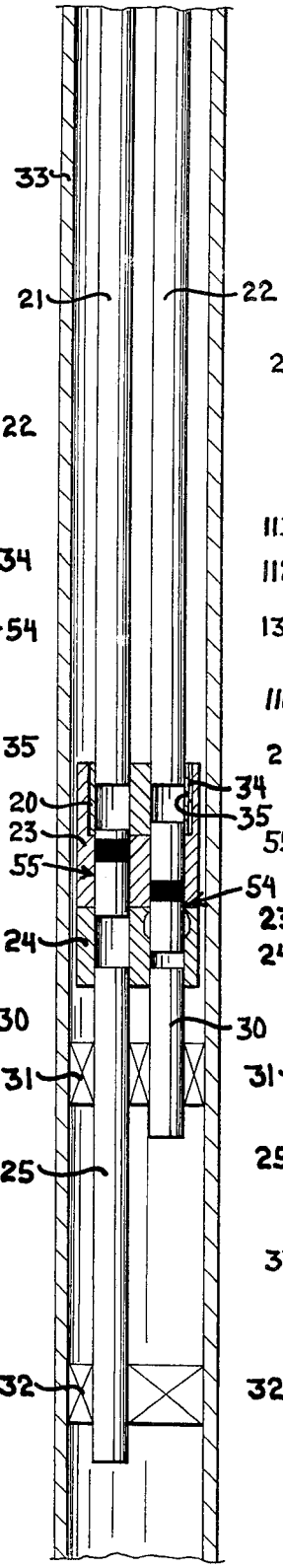
FIG. 4 is a schematic view similar to FIG. 3 illustrating the two tubing strings connected with the well packers in accordance with the invention.

The well tubing system of FIG. 11 wherein both tubing strings may be independently retrieved and run is initially installed in the same manner as previously described and illustrated in FIGS. 3 and 4. The complete system is installed as a unit and thereafter may be retrieved and rerun as a unit or each of the two tubing strings may be individually retrieved and rerun. In the event that both of the tubing strings are retrieved at the same time it is necessary that the larger of the two strings be reinstalled first. This will be evident from the structure of the scoop head 112′ which would possibly guide the smaller string into the larger bore if such larger bore were vacant at the time the smaller string was run into the well. By running the larger string first it can only enter the larger bore 114′ so that when the smaller string is run thereafter it is limited to entry into the smaller bore 111′.

The well system of the invention was initially described as being installed in two stages with the well packers along with the body 24 and the guide sleeve 23 being initially run into the well, the packer set, and the tubing string assembly including the two tubing strings along with the guide head being lowered and coupled with the guide sleeve in a second operation. If desired the entire well systems described may each be installed in a single step. The packers are connected together as illustrated supported from the body 24 while the guide head 20 is coupled into the guide sleeve 23 with the entire assembly being suspended in the well bore and lowered on the tubing strings 21 and 22. At the proper depth the packers are then set in sealed relationship with the well casing. Thereafter, the tubing strings along with the guide head may be retrieved and rerun as a unit and in the case of the forms of the invention having individually latched tubing strings either or both of the strings may be retrieved and reinstalled.

Thus, a simple unique well tubing system has been described and illustrated which permits running and retrieving a plurality of tubing strings as a unit without turning the tubing strings at the surface to achieve the necessary rotational alignment to couple the tubing strings into the packer system employed. While the systems have been described in terms of the use of two tubing strings it will be obvious that the system is not so limited and may be readily adapted to three or more tubing strings each of which other than the primary string is coupled into the guide head in the manner described and illustrated for the secondary tubing string. In the case of the use of such additional tubing strings the individual retrievable feature shown may be also adapted to such additional strings. While it is not necessary that the strings be run coupled with and supported from the christmas tree the fact that no rotation at the surface is necessary particularly adapts the system to those instances where it is desired that the tubing strings and christmas tree be simultaneously installed. This has been indicated as especially desirable in offshore installations. In addition to permitting the unit installation and retrieval of several tubing strings some forms of the invention additionally allow the independent separate retrieval and rerunning of the strings once the system has been initially installed. The unit installation and retrieval capability is a substantial cost and time saving factor in well operations.

What is claimed is:

1. A well flow conductor system comprising: first fluid coupling means connectible with a multiple string well packer having a plurality of separate flow passages therethrough, said first coupling means having separate flow passages equal in number and position to communicate with said flow passages in said packer when said first coupling means is connected with said packer; second fluid coupling means adapted to releasably couple with said first coupling means and being connectible with a plurality of separate well flow conductors, said second coupling means having flow passages equal in number and communicating with said first coupling means when said first and second coupling means are connected together; first guide means on said first coupling means; and second guide means on said second coupling means for coacting with said first guide means to rotationally align said second guide means with said first guide means responsive to longitudinal motion only as said second guide means is moved toward said first guide means for coupling said first and second guide means together.

2. A well flow conductor system in accordance with claim 1 wherein said first and second guide means are adapted to rotate said second coupling means a maximum of 180°.

3. A well flow conductor system in accordance with claim 2 wherein one of said guide means includes a guide lug and the other of said guide means is provided with a guide slot adapted to receive said guide lug and defined by cam surfaces engageable with said guide lug for rotating said second coupling means from any position of rotation at which said coupling means engages said first coupling means to a single predetermined position of rotation at which the fluid passages in both of said coupling means communicate with each other for flow through said well packer into said flow conductors.

4. A well flow conductor system in accordance with claim 3 wherein one of said coupling means includes a guide sleeve and the other of said coupling means includes a guide head insertable into said guide sleeve.

5. A well flow conductor system in accordance with claim 4 wherein said guide lug is secured with and extends radially inwardly in said guide sleeve and said guide slot is provided in the outer surface of said guide head.

6. A well flow conductor system in accordance with claim 5 wherein said guide slot comprises a first longitudinally extending narrow portion providing a sliding fit with said guide lug and positioned to hold said second coupling means against rotation at said predetermined position of rotation as said second coupling means is moved together with said first coupling means, said guide slot having a second entrance portion defined by edge surfaces extending divergently toward a first end of said second coupling means circumferentially around said coupling means, said diverging slot edge surfaces substantially meeting on the opposite side of said second coupling means from said first slot portion, each of said slot edge surfaces defining said entrance portion of said slot being adapted to coact with said guide lug to rotate said second coupling means a maximum of 180° toward said first guide slot portion, and said guide slot having a third exit portion defined by edge surfaces extending from said second end of said second coupling means convergently to said first slot portion.

7. A well flow conductor system in accordance with claim 6 wherein said slot edge surfaces defining said entrance and exit portions of said guide slot on said second coupling means extend at angles of substantially 45° to said first longitudinal portion of said guide slot.

8. A well flow conductor system in accordance with claim 1 including releasable flow conductor coupling means connected with said second fluid coupling means for releasing and connecting said one of said well flow conductors from said second coupling means independently of the other of said well flow conductors connected with said second fluid coupling means.

9. A well flow conductor system in accordance with claim 1 including flow conductor coupling means connected with said second fluid coupling means for releasably connecting each flow conductor in said system with said second fluid coupling means whereby each flow conductor in said system may be connected with and disconnected from said second coupling means independently of the other flow conductors connected with said second fluid coupling means.

10. A well flow conductor system comprising: a fluid coupling body having means for connection with a multiple string well packer and being provided with a plurality of separate flow passages equal in number and position to communicate with flow passages through said packer; a guide sleeve secured with said fluid coupling body and having a longitudinal bore encompassing and communicating with said bores through said fluid coupling body; a guide lug secured with said guide sleeve and projecting inwardly into said bore through said sleeve; a guide head having means at a first end for connection with separate spaced well flow conductors and having separate longitudinal bores therethrough equal in number and spaced to communicate with said bores through said fluid coupling body when said guide head is connected with said fluid coupling head; and means providing a guide slot in the outer surface of said guide head adapted to coact with said guide lug in said guide sleeve to rotate said guide head from any position of rotation upon entry of said guide head into said guide sleeve to a single position of said guide head in said guide sleeve at which said bores in said guide head are aligned with corresponding bores in said fluid coupling body as said guide head is telescoped into said guide sleeve into a fluid type coupled relationship with said fluid coupling body.

11. A well flow conductor system in accordance with claim 10 wherein said guide slot in said guide head has an entrance portion defined by slot edge cam surfaces extending from said second end of said guide head divergently and circumferentially around said head to a central slot portion of uniform width along the opposite side of said head, said slot cam surfaces defining said entrance portion rotating said head a maximum of 180° upon engagement with said guide lug and said central slot portion of uniform width being located to hold said guide head at a predetermined rotational position at which said corresponding bores of said head and said fluid coupling body are aligned with each other.

12. A well flow conductor system in accordance with claim 11 including releasable latch means connected with said guide head for releasably latching said guide head in said guide sleeve with said fluid coupling body.

13. A well flow conductor system in accordance with claim 12 wherein said releasable latch means comprises a collet latch having a longitudinally movable collet and a collet locking sleeve secured with said guide head and insertable into one of said bores of said fluid coupling body, said collet latch being connected into one of said bores of said guide head.

14. A well flow conductor system in accordance with claim 12 wherein a tubular seal unit is connected with said guide head into the other of said bores of said head for insertion into corresponding bores of said fluid coupling body for effecting a fluid tight communication between the bores of said fluid coupling body and of said guide head.

15. A well flow conductor system in accordance with claim 14 including releasable flow conductor latch means connected with said guide head for releasable coupling of at least one of said flow conductors connectible with said guide head.

16. A well flow conductor system in accordance with claim 14 including releasable latch means connected with said guide head into each of said bores through said guide head for independently connecting and disconnecting each of said flow conductors coupled with said guide head; and a flow conductor positioning head connected with each of said last mentioned means and supported from said guide head for directing each of said independently releasable and connectible flow conductors into the correct bore of said guide head.

* * * * *